US008040283B2

(12) United States Patent
Cheng et al.

(10) Patent No.: US 8,040,283 B2
(45) **Date of Patent: *Oct. 18, 2011**

(54) DUAL BAND ANTENNA

(75) Inventors: Pi-Hsi Cheng, Hsinchu County (TW); Chang-Jung Lee, Taoyuan County (TW)

(73) Assignee: Arcadyan Technology Corporation, Hsinchu (TW)

( * ) Notice: Subject to any disclaimer, the term of this patent is extended or adjusted under 35 U.S.C. 154(b) by 384 days.

This patent is subject to a terminal disclaimer.

(21) Appl. No.: 12/289,933

(22) Filed: Nov. 7, 2008

(65) Prior Publication Data

US 2009/0128420 A1 May 21, 2009

(30) Foreign Application Priority Data

Nov. 16, 2007 (TW) ..... 96143571 A

(51) Int. Cl.
*H01Q 1/24* (2006.01)
*H01Q 1/38* (2006.01)

(52) U.S. Cl. ..... 343/702; 343/700 MS; 343/846

(58) Field of Classification Search ..... 343/700 MS, 343/702, 846

See application file for complete search history.

(56) References Cited

U.S. PATENT DOCUMENTS

| | | | | |
|---|---|---|---|---|
| 7,161,543 | B2 * | 1/2007 | Cheng et al. | 343/702 |
| 7,375,686 | B2 * | 5/2008 | Ku et al. | 343/700 MS |
| 2004/0008146 | A1 | 1/2004 | Ikegaya et al. | |
| 2005/0190108 | A1 | 9/2005 | Lin et al. | |
| 2007/0001913 | A1 * | 1/2007 | Tsai et al. | 343/702 |

FOREIGN PATENT DOCUMENTS

| | | |
|---|---|---|
| GB | 2373638 | 9/2002 |
| TW | 261952 | 9/2006 |
| WO | 2006070017 A1 | 7/2006 |

OTHER PUBLICATIONS

Search Report issued in related EP application No. 08019776.7, dated Mar. 20, 2009, 7 pages.

* cited by examiner

*Primary Examiner* — Hoang V Nguyen
(74) *Attorney, Agent, or Firm* — Bacon & Thomas, PLLC

(57) ABSTRACT

An antenna applied in a communication device is provided. The antenna includes a conductive supporting portion, a radiator and a grounding portion. The radiator operates in a first frequency band. The grounding portion is connected to the radiator through the conductive supporting portion. The grounding portion includes a cavity extended from a top surface of the grounding portion into the interior of the grounding portion. A resonant cavity operating in a second frequency band is formed between the radiator and the cavity.

24 Claims, 3 Drawing Sheets

DUAL BAND ANTENNA

This application claims the benefit of Taiwan application Serial No. 96143571, filed Nov. 16, 2007, the subject matter of which is incorporated herein by reference.

BACKGROUND OF THE INVENTION

1. Field of the Invention

The invention relates in general to an antenna, and more particularly to a planar inverse-F antenna (IFA).

2. Description of the Related Art

As science and technology have gained rapid advance nowadays, a large variety of compact antennas have been developed and applied in various electronic devices such as mobile phones and notebook computers. For example, the planar inverse-F antenna (PIFA), which has compact structure and excellent transmission efficiency and can be easily disposed on an inner wall of an electronic device, has been widely applied in the wireless transmission of many electronic devices. However, most of conventional PIFAs are single band antenna, and can only support a narrower frequency band.

SUMMARY OF THE INVENTION

The invention is directed to an antenna capable of supporting more than two frequency bands. Compared with the conventional planar inverse-F antenna (PIFA), the antenna disclosed in the invention can receive and transmit data in a wider frequency band.

According to a first aspect of the present invention, an antenna applied in a communication device is provided. The antenna includes a conductive supporting portion, a radiator and a grounding portion. The radiator operates in a first frequency band. The grounding portion is connected to the radiator through the conductive supporting portion. The grounding portion includes a cavity extended from a top surface of the grounding portion into the interior of the grounding portion. A resonant cavity operating in a second frequency band is formed between the radiator and the cavity.

The invention will become apparent from the following detailed description of the preferred but non-limiting embodiments. The following description is made with reference to the accompanying drawings.

DETAILED DESCRIPTION OF THE INVENTION

A planar inverse-F antenna (PIFA) is disclosed in the invention. The PIFA is capable of operating in two different frequency bands by a radiator and a resonant cavity which is defined by the radiator and a grounding portion thereof.

Figure 1:
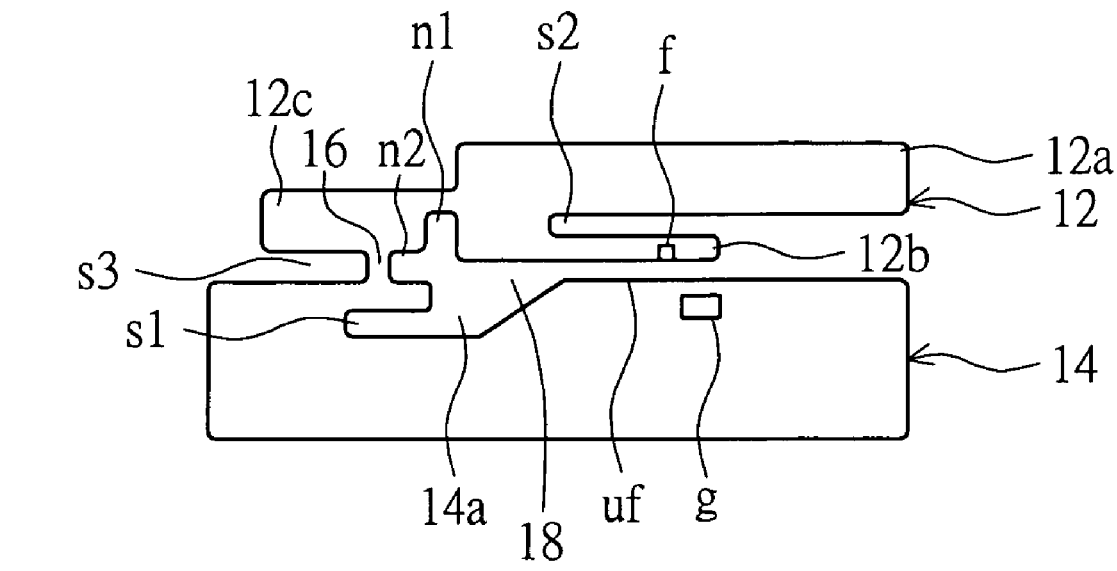
FIG. 1 shows a structural diagram of an antenna according to a preferred embodiment of the invention.

Referring to FIG. 1, a structural diagram of an antenna according to a preferred embodiment of the invention is shown. The antenna 10 is applied in an electronic device for transmitting data according to the communication protocol 802.11 a/b/g/n set by The Institute of Electrical and Electronics Engineers (IEEE). The antenna 10 supports data transmission and covers the frequency bands of 2.4 GHz to 2.5 GHz and 4.9 GHz to 5.85 GHz.

The antenna 10 includes a radiator 12, a grounding portion 14 and a conductive supporting portion 16. The antenna 10 is a PIFA for example, wherein the radiator 12, the grounding portion 14 and the conductive supporting portion 16 are all disposed on the same conductor plane. The thickness of the conductor plane ranges from 0.6 mm to 0.8 mm. For example, the thickness of the conductor plane is 0.8 mm.

The radiator 12 is adjusted to operate in a first frequency band, wherein the length of the radiator 12 is approximately a quarter of the wavelength of the central frequency of the first frequency band. The signal feed-in point f of the antenna 10 is disposed in the radiator 12.

The grounding portion 14 is connected to the radiator 12 through the conductive supporting portion 16. The grounding portion 14 includes a top surface uf. The top surface uf includes a cavity 14*a* extended from top surface uf into the interior of the grounding portion 14. The radiator 12 and the cavity 14*a* are connected to form a resonant cavity 18 operating in a second frequency band. The second frequency band is, for example, higher than the first frequency band.

The cavity 14*a* includes a slot s1 disposed in parallel with the top surface uf. The slot s1 has a closed end and an opening end. The direction of the opening is substantially parallel to the top surface uf.

The radiator 12 includes a radiator body 12*a* and a radiator branching portion 12*b*. The radiator branching portion 12*b* and the radiator body 12*a* are disposed in parallel. The radiator branching portion 12*b* includes a first surface and a second surface. The first surface is adjacent to the grounding portion 14. The signal feed-in point f of the antenna 10 is disposed on the part of the radiator branching portion 12*b* near the end terminal of the radiator branching portion 12*b*. The grounding point g of the antenna 10 is disposed on the part of the grounding portion 14 near the signal feed-in point f of the radiator branching portion 12*b*.

The radiator 12 includes an indentation n1, wherein the direction of the opening of the indentation n1 is substantially perpendicular to the radiator 12. The indentation n1 and the resonant cavity 18 are interconnected. The radiator 12, the conductive supporting portion 16 and the grounding portion 14 together define an indentation n2. The direction of the opening of the indentation n2 is substantially perpendicular to the opening of the indentation n1. The indentation n2 and the resonant cavity 18 are interconnected.

The length and width of the slot s1 and the indentations n1 and n2 are related to the length of the current path in the resonant cavity 18 and the impedance of the resonant cavity 18. By way of adjusting the length and width of the slot s1 and the indentations n1 and n2, the antenna is capable of operating in a second frequency band. Thus, when the resonant cavity 18 operates in a second frequency band, the resonant cavity 18 and the signal wiring (not illustrated) are substantially impedance matching.

The second surface of the radiator branching portion 12*b* and the radiator body 12*a* together define a slot s2. The slot s2 has a closed end and an opening end. The direction of the opening of the slot s2 is substantially parallel to the radiator body 12*a*.

The radiator 12 further includes a protruding portion 12 connected to the conductive supporting portion 16. The protruding portion 12*c* and the radiator 12 are substantially disposed in parallel. The protruding portion 12*c*, the conductive supporting portion 16 and the grounding portion 14 further define a slot s3. The slot s3 has a closed end and an opening end. The direction of the opening of the slot s3 is substantially parallel to the radiator body 12*a*.

The length and width of the slot s2, s3 and the protruding portion 12*c* are related to the length of the current path in the radiator 12 and the impedance of the radiator 12. By way of adjusting the length and width of the slots s2 and s3 and the protruding portion 12*c*, the antenna is capable of operating in a first frequency band. Thus, when the radiator 12 operates in a first frequency band, the radiator 12 and the signal wiring (not illustrated) are substantially impedance matching.

Figure 2:
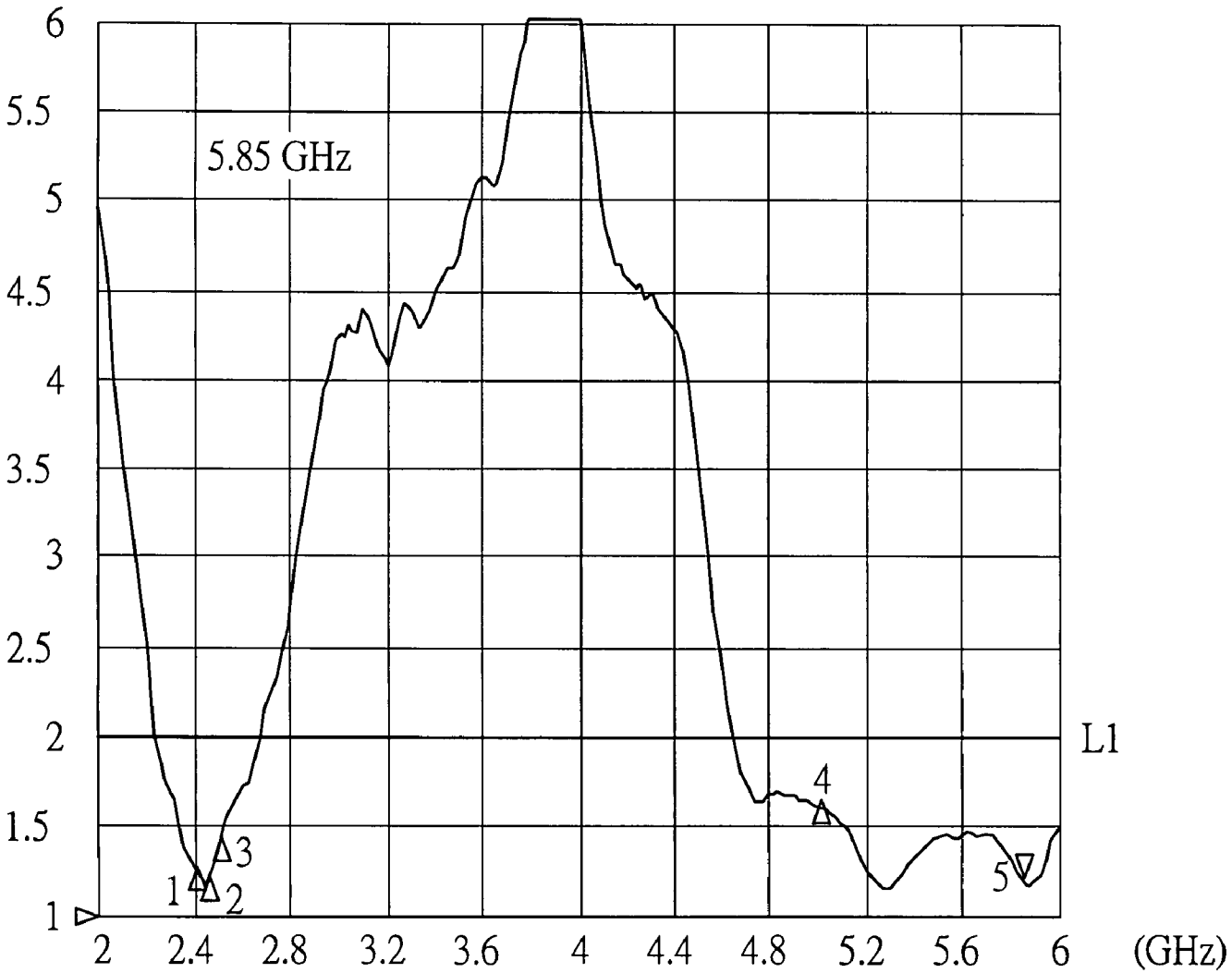
FIG. 2 shows a standing wave ratio diagram of the antenna 10 of FIG. 1.
Figure 3:
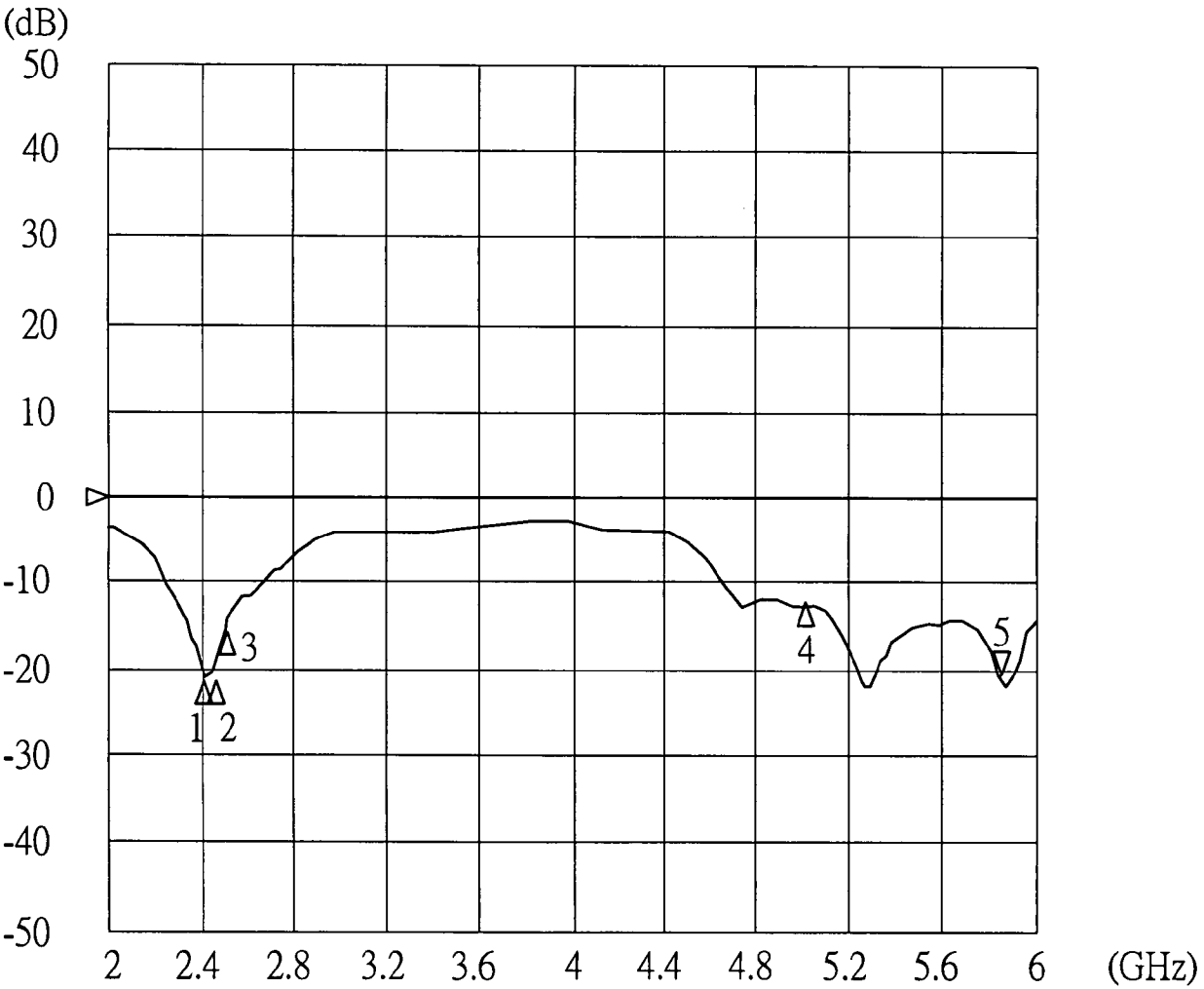
FIG. 3 shows a return loss diagram of the antenna 10 of FIG. 1.

Referring to FIG. 2 and FIG. 3. FIG. 2 shows a standing wave ratio diagram of the antenna 10 of FIG. 1. FIG. 3 shows a return loss diagram of the antenna 10 of FIG. 1. According to the band-width reference line L1 where the standing wave ratio (SWR) is 2 and the band-width reference line L2 where the return loss (return loss) is −10 decibel (dB), the first frequency band of the present embodiment of the invention substantially ranges from 2.3 GHz to 2.7 GHz, and the second frequency band substantially ranges from 4.65 GHz to 6 GHz and over. The first frequency band substantially includes a low frequency band of 2.4 GHz~2.5 GHz defined in the communication protocol 802.11 b/g/n, the second frequency band substantially includes a high frequency of 4.9 GHz~5.85 GHz defined in the communication protocol 802.11 a/n. Thus, the antenna 10 disclosed in the present embodiment of the invention effectively supports data transmission adopting communication protocol 802.11 a/b/g/n.

In FIG. 2, the actual standing wave ratios (SWR) (denoted as measuring points 1~5 in FIG. 2) corresponding to the frequencies of 2.4 GHz, 2.45 GHz, 2.5 GHz and 5 GHz are 1.2622, 1.2032, 1.4275 and 1.6422, respectively. In FIG. 3, the actual return losses (denoted as measuring points 1~5 in FIG. 3) corresponding to the frequencies of 2.4 GHz, 2.45 GHz, 2.5 GHz and 5 GHz are −21.653 dB, −21.668 dB, −16.125 dB and −12.483 dB, respectively. Thus, the antenna 10 disclosed in the present embodiment of the invention effectively supports data transmission adopting communication protocol 802.11 a/b/g/n.

In the present embodiment of the invention, the slot s1 and the top surface uf are exemplified as being in parallel to each other, but the direction of the slot s1 does not necessarily have to be parallel to the top surface uf, and other types of relationship would also do. Likewise, the direction of the opening of the indentation n1 does not necessarily have to be perpendicular to that of the opening of the indentation n2, and other types of relationship would also do.

The PIFA disclosed in the present embodiment of the invention operates is capable of operating in two different frequency bands by a radiator and a resonant cavity which is defined by the radiator and a grounding portion thereof. Thus, compared with the conventional PIFA, the antenna disclosed in the present embodiment of the invention can receive and transmit data in a wider frequency band.

Furthermore, as the structure of the antenna disclosed in the present embodiment of the invention is disposed on the same conductor plane, the antenna disclosed in the present embodiment of the invention further has the advantage of being easily disposed on a side wall of the mechanism of the electronic device using the same.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. An antenna applied in a communication device, the antenna comprising:

a conductive supporting portion;

a radiator operating in a first frequency band; and a grounding portion connected to the radiator through the conductive supporting portion, wherein the grounding portion comprises:

a cavity extended from a top surface of the grounding portion into the interior of the grounding portion;

wherein, a resonant cavity operating in a second frequency band is formed between the radiator and the cavity.

2. The antenna according to claim 1, wherein the cavity comprises a first slot having a first closed end and a first opening end, the direction of the opening of the first slot is substantially parallel to the top surface, and the length and width of the first slot are related to the frequency level of the second frequency band.

3. The antenna according to claim 1, wherein the radiator comprises:

a first indentation, wherein the direction of the opening of the first indentation is substantially perpendicular to the radiator, the first indentation and the resonant cavity are interconnected, and the size of the first indentation is related to the frequency level of the second frequency band.

4. The antenna according to claim 3, wherein the radiator, the conductive supporting portion and the grounding portion together define a second indentation, the direction of the opening of the second indentation is substantially perpendicular to the opening of the first indentation, the second indentation and the resonant cavity are interconnected, and the size of the second opening is related to the frequency level of the second frequency band.

5. The antenna according to claim 1, wherein the radiator comprises:

a radiator body; and a radiator branching portion disposed in parallel with the radiator body, wherein the radiator branching portion comprises a signal feed-in point.

6. The antenna according to claim 5, wherein the first lateral side of the radiator branching portion and the radiator body together define a second slot having a second closed end and a second opening end, and the direction of the opening of the second slot is substantially parallel to the radiator body.

7. The antenna according to claim 1, wherein the radiator further comprises:

a protruding portion connected to the conductive supporting portion, wherein the length and width of the protruding portion are related to the frequency level of the first frequency band.

8. The antenna according to claim 7, wherein the protruding portion, the conductive supporting portion and the grounding portion together further define a third slot having a third closed end and a third opening end, the direction of the opening of the third slot is substantially parallel to the radiator body, and the length and width of the third slot are related to the frequency level of the first frequency band.

9. The antenna according to claim 1, wherein the radiator, the conductive supporting portion and the grounding portion are formed in the same plane structure.

10. The antenna according to claim 1, wherein the antenna is a planar inverse-F antenna (PIFA).

11. An antenna applied in a communication device, the antenna comprising:

a conductive supporting portion;

a radiator comprising a signal feed-in point and operating in a first frequency band;

a grounding portion comprising a grounding point disposed in the vicinity of the signal feed-in point, the grounding portion is connected to the radiator through the conductive supporting portion;

a cavity extended from a top surface of the grounding portion into the interior of the grounding portion; and a plurality of indentations defined by the radiator, the conductive supporting portion and the grounding portion, wherein the indentations are disposed on the parts of the radiator, the conductive supporting portion and the grounding portion near the cavity; and wherein, the radiator, the cavity and the indentations form a resonant cavity operating in a second frequency band.

12. The antenna according to claim 11, wherein the cavity comprises a first slot having a first closed end and a first opening end, the direction of the opening of the first slot is substantially parallel to the top surface, and the length and width of the first slot are related to the frequency level of the second frequency band.

13. The antenna according to claim 11, wherein the size of the indentations is related to the frequency level of the second frequency band.

14. The antenna according to claim 11, wherein the radiator comprises:

a radiator body;

a radiator branching portion disposed in parallel with the radiator body, wherein the signal feed-in point is located on the radiator branching portion; and a second slot disposed between the first lateral side of the radiator branching portion and the radiator body, wherein the second slot has a second closed end and a second opening end, and the direction of the opening of the second slot is substantially parallel to the radiator body.

15. The antenna according to claim 11, wherein the radiator further comprises:

a protruding portion connected to the conductive supporting portion, wherein the protruding portion, the conductive supporting portion and the grounding portion further define a third slot having a third closed end and a third opening end, the direction of the opening of the third slot is substantially parallel to the radiator body, and the length and width of the protruding portion and the third slot are related to the frequency level of the first frequency band.

16. The antenna according to claim 1, wherein the radiator, the conductive supporting portion and the grounding portion are formed in the same plane structure.

17. The antenna according to claim 11, wherein the antenna is a planar inverse-F antenna (PIFA).

18. An antenna applied in a communication device, the antenna comprising:

a conductive supporting portion;

a radiator comprising a protruding portion connected to the conductive supporting portion, wherein the radiator operates in a first frequency band; and a grounding portion comprising a cavity extended from a top surface of the grounding portion into the interior of the grounding portion, wherein the grounding portion is connected to the radiator through the conductive supporting portion;

wherein, a resonant cavity operating in a second frequency band is formed between the radiator and the cavity.

19. The antenna according to claim 18, wherein the cavity comprises a first slot having a first closed end and a first opening end, the direction of the opening of the first slot is substantially parallel to the top surface, and the length and width of the first slot are related to the frequency level of the second frequency band.

20. The antenna according to claim 18, comprising a plurality of indentations disposed on the part of the radiator, the conductive supporting portion and the grounding portion near the cavity, wherein the size of the indentations is related to the frequency level of the second frequency band.

21. The antenna according to claim 18, wherein the radiator comprises:

a radiator body; and a radiator branching portion disposed in parallel with the radiator body, wherein the signal feed-in point is disposed on the radiator branching portion; and a second slot disposed between the first lateral side of the radiator branching portion and the radiator body, wherein the second slot has a second closed end and a second opening end, and the direction of the opening of the second slot is substantially parallel to the radiator body.

22. The antenna according to claim 18, wherein the radiator further comprises:

a protruding portion connected to the conductive supporting portion, wherein the protruding portion, the conductive supporting portion and the grounding portion together further define a third slot having a third closed end and a third opening end, the direction of the opening of the third slot is substantially parallel to the radiator body, and the length and width of the protruding portion and the third slot are related to the frequency level of the first frequency band.

23. The antenna according to claim 18, wherein the radiator, the conductive supporting portion and the grounding portion are formed in the same plane structure.

24. The antenna according to claim 18, wherein the antenna is a planar inverse-F antenna (PIFA).

* * * * *